US009353594B2

(12) United States Patent
Arya

(10) Patent No.: US 9,353,594 B2
(45) Date of Patent: May 31, 2016

(54) METHOD AND APPARATUS FOR SUBSEA HOSE REPLACEMENT

(71) Applicant: Transocean Sedco Forex Ventures Limited, George Town Grand Cayman (KY)

(72) Inventor: Harinder Singh Arya, Houston, TX (US)

(73) Assignee: TRANSOCEAN SEDCO FOREX VENTURES LIMITED (KY)

( * ) Notice: Subject to any disclaimer, the term of this patent is extended or adjusted under 35 U.S.C. 154(b) by 0 days.

(21) Appl. No.: 14/623,055

(22) Filed: Feb. 16, 2015

(65) Prior Publication Data

US 2015/0233193 A1 Aug. 20, 2015

Related U.S. Application Data

(60) Provisional application No. 61/941,356, filed on Feb. 18, 2014.

(51) Int. Cl.
*E21B 19/00* (2006.01)
*E21B 33/064* (2006.01)
*E21B 33/038* (2006.01)

(52) U.S. Cl.
CPC ..... *E21B 33/064* (2013.01); *E21B 33/038* (2013.01)

(58) Field of Classification Search
CPC ..... E21B 17/02; E21B 17/08; E21B 33/038; E21B 19/002; E21B 33/064; F16L 21/08; F16L 23/024; F16L 23/032; F16L 25/14
See application file for complete search history.

(56) References Cited

U.S. PATENT DOCUMENTS

| | | | | |
|---|---|---|---|---|
| 5,697,834 | A | 12/1997 | Heumann et al. | |
| 6,186,239 | B1 | 2/2001 | Monjure et al. | |
| 7,631,580 | B2 * | 12/2009 | Lu | B25B 13/488 81/56 |
| 7,806,187 | B2 * | 10/2010 | Lugo | E21B 33/038 166/338 |
| 8,505,980 | B2 * | 8/2013 | Vatne | E21B 17/01 285/27 |
| 2001/0034153 | A1 * | 10/2001 | McIntosh | E21B 33/038 439/364 |
| 2005/0070150 | A1 * | 3/2005 | Williams | E21B 23/006 439/374 |
| 2009/0252559 | A1 * | 10/2009 | Masters | B63C 11/52 405/195.1 |
| 2010/0186964 | A1 * | 7/2010 | Reid | E21B 41/04 166/341 |
| 2011/0304136 | A1 | 12/2011 | Webster et al. | |
| 2012/0273213 | A1 | 11/2012 | Blalock et al. | |
| 2013/0011201 | A1 * | 1/2013 | Gutierrez | F16L 1/26 405/170 |

* cited by examiner

*Primary Examiner* — James G Sayre
(74) *Attorney, Agent, or Firm* — Norton Rose Fulbright US LLP

(57) ABSTRACT

Systems and methods for replacing a hose coupled to a BOP located subsea are provided. Embodiments include coupling an electromechanical tool to a hose fitting coupled to the BOP, and rotating, with the electromechanical tool, a first swivel fitting with respect to the hose fitting until a first hose is decoupled from the hose fitting. Some embodiments may also include coupling, with the electromechanical tool, a second swivel fitting to the hose fitting to couple a second hose to the hose fitting. The second swivel fitting may be rotated with respect to the hose fitting until the second hose is securely coupled to the hose fitting.

9 Claims, 5 Drawing Sheets

METHOD AND APPARATUS FOR SUBSEA HOSE REPLACEMENT

CROSS REFERENCE TO RELATED APPLICATION

This application claims the benefit of priority of provisional Patent Application No. 61/941,356, filed on Feb. 18, 2014, the entire contents of which are incorporated herein by reference.

FIELD OF THE INVENTION

The instant disclosure relates to replacement of hydraulic hoses. More specifically, this disclosure relates to replacement of hydraulic hoses coupled to a blowout preventer (BOP) located subsea.

BACKGROUND

A significant financial loss to companies in the offshore oil drilling industry may be attributed to the amount of time a blowout preventer (BOP) spends disconnected from an offshore well when the BOP is supposed to be connected to the well to allow for safe retrieval of fluids from the well. BOPs are pulled from wells for numerous reasons besides general maintenance of the BOPs. For example, one common reason for pulling a BOP from a well is a faulty hydraulic hose connected to the BOP. Hoses may become faulty for a variety of reasons, such as a leak in the hose or a loosened/bad connection. Because BOPs may have tens, or even hundreds, of hose connections, a BOP may need to be pulled from a well multiple times during scheduled drilling times in order to fix or replace faulty hoses. Therefore, a key to decreasing the financial losses is reducing the number of BOP pulls to fix/replace faulty hoses.

SUMMARY

Reducing the number of BOP pulls to fix/replace faulty hoses may be achieved by replacing, at subsea, the faulty hoses coupled to the BOP as opposed to on an offshore vessel after the BOP has been pulled. According to one embodiment, an apparatus for replacing a first hose coupled to a BOP located subsea may include a first wrench head configured to couple to a hose fitting coupled to the BOP. The apparatus may also include a second wrench head coupled to the first wrench head and configured to couple to a swivel fitting, wherein the swivel fitting couples a first hose to the hose fitting. The apparatus may further include a powering unit coupled to the second wrench head, wherein the powering unit is configured to cause the second wrench head to rotate with respect to the first wrench head, wherein the rotation of the second wrench head causes the swivel fitting to rotate with respect to the hose fitting.

According to another embodiment, an apparatus for replacing a hose coupled to a BOP located subsea may include a means for coupling to a hose fitting coupled to the BOP and a means for coupling to a swivel fitting, wherein the swivel fitting couples a first hose to the hose fitting, and wherein the means for coupling to the swivel fitting is coupled to the means for coupling to the hose fitting. The apparatus may also include a means for causing the means for coupling to the swivel fitting to rotate with respect to the means for coupling to the hose fitting, wherein the rotation of the means for coupling to the swivel fitting causes the swivel fitting to rotate with respect to the hose fitting, and wherein the means for causing the means for coupling to the swivel fitting to rotate is coupled to the means for coupling to the swivel fitting.

According to yet another embodiment, a method for replacing a hose coupled to a BOP located subsea may include coupling an electromechanical tool to a hose fitting coupled to the BOP and rotating, with the electromechanical tool, a first swivel fitting with respect to the hose fitting, wherein the first swivel fitting couples a first hose to the hose fitting, and wherein the first swivel fitting is rotated until the first hose is decoupled from the hose fitting. The method may also include coupling, with the electromechanical tool, a second swivel fitting to the hose fitting, wherein the second swivel fitting couples a second hose to the hose fitting. The method may further include rotating, with the electromechanical tool, the second swivel fitting with respect to the hose fitting, wherein the second swivel fitting is rotated until the second hose is securely coupled to the hose fitting.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features that are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Figure 1A:
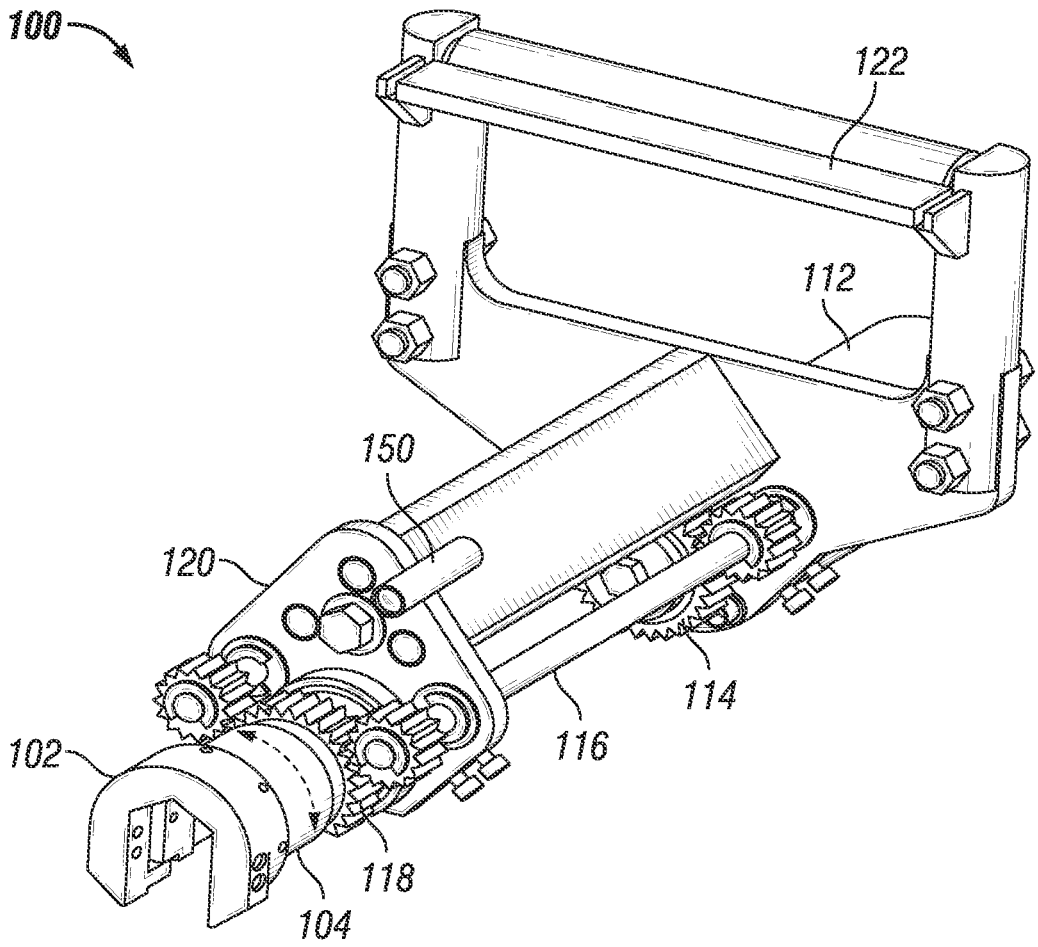
FIGS. 1A and 1B are schematic models illustrating apparatuses for replacing a hose coupled to a BOP located subsea according to embodiments of the disclosure.
Figure 2:
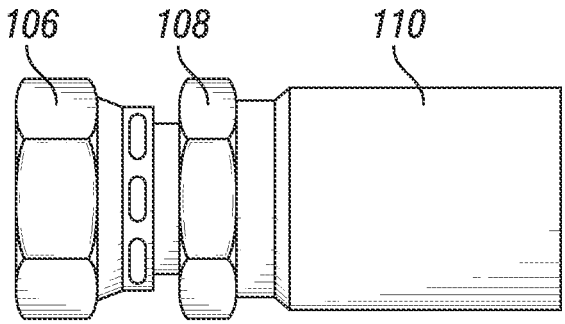
FIG. 2 is a schematic model illustrating a hose fitting and swivel fitting to which an apparatus for replacing a hose may be coupled according to one embodiment of the disclosure.

FIG. 1A provides an illustration of an apparatus for replacing a hose coupled to a BOP located subsea according to one embodiment of the disclosure. The apparatus may include a first wrench head 102 and a second wrench head 104. The first wrench head 102 may be configured to couple to a hose fitting (not shown) coupled to a BOP (not shown). In some embodiments, the first wrench head 102 may include one or more spring loaded ball bearings (not shown) to aid in coupling to the hose fitting. The second wrench head 104 may be coupled to the first wrench head 102 in a manner that allows the first wrench head 102 to remain in place while the second wrench head 104 rotates with respect to the first wrench head 102. The second wrench head 104 may be configured to couple to a swivel fitting (not shown). As an example, and not limitation, FIG. 2 provides an illustration of a hose fitting and swivel fitting to which an apparatus for replacing a hose may be coupled according to one embodiment of the disclosure. According to one embodiment, the first wrench head 102 and second wrench head 104 may couple to the hose fitting 106 and the swivel fitting 108, respectively. In some embodiments, the hose fitting 106 may be coupled to a BOP (not shown), and the swivel fitting 108 may couple a hose 110 to the hose fitting 106. According to one embodiment, the hose and/or swivel fittings may be Joint Industry Council (JIC) standard fittings.

Returning to FIG. 1A, the apparatus 100 may also include a powering unit 112. The powering unit 112 may be coupled to the second wrench head 104 and may be configured to cause the second wrench head 104 to rotate with respect to the first wrench head 102. For example, the powering unit 112 may include a motor (not shown). The motor may be coupled to a drive gear 114 that may receive energy from the motor. In some embodiments, the drive gear 114 may be coupled to at least one drive shaft 116 to transfer motion from the drive gear 114 to another gear. For example, according to one embodiment, the apparatus 100 may also include at least one spur gear 118 that is driven by the drive shaft 116 to transmit torque to the second wrench head 104. As the drive gear 114 drives the drive shaft 116, the drive shaft 116 may drive the spur gear 118 to transfer motion from the drive gear 114 to the spur gear 118. According to an embodiment, as the spur gear 118 transmits torque to the second wrench head 104, the second wrench head 104 may rotate, which may cause the swivel fitting to rotate with respect to the hose fitting. In some embodiments, while the second wrench head 104 and the swivel fitting rotate, the first wrench head 102 may remain coupled to the hose fitting and the hose fitting may remain coupled to the BOP such that the first wrench head 102 experiences minimal or no rotation.

Figure 1B:
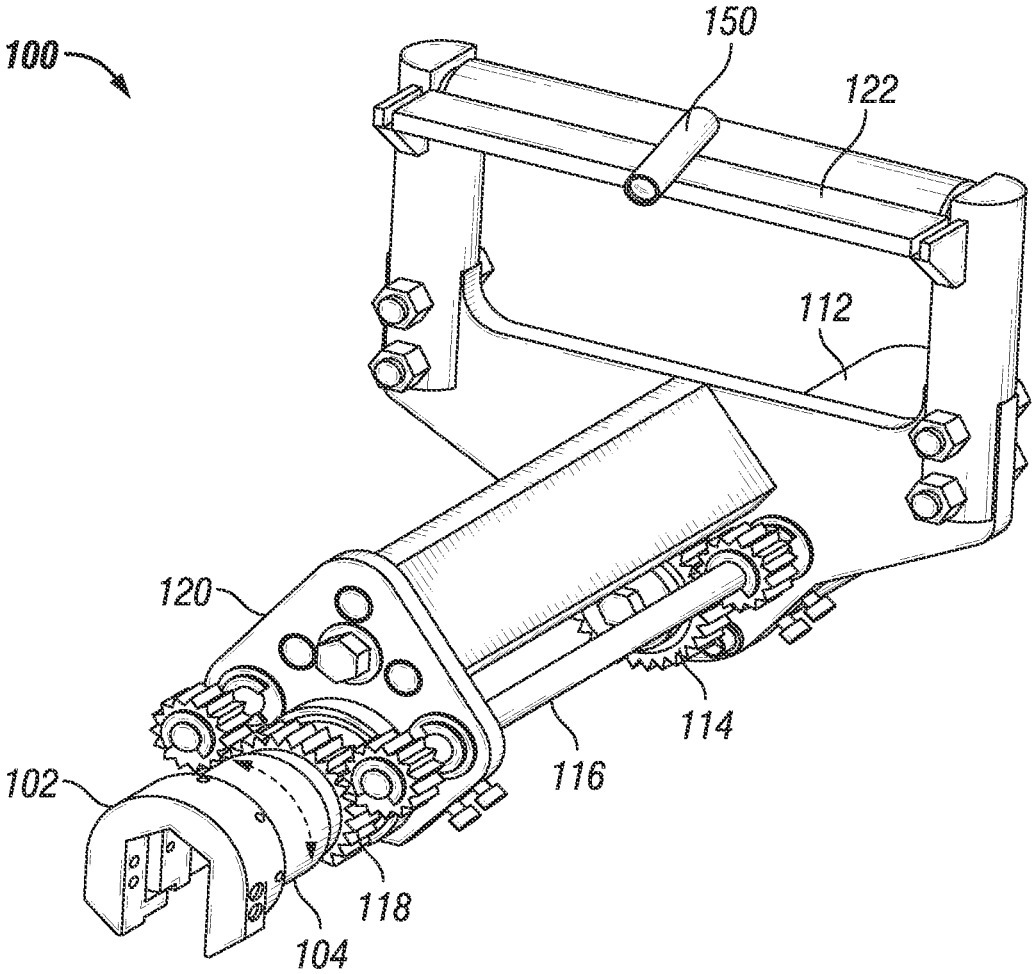

In some embodiments, the apparatus 100 may also include a camera 150 that may be positioned on the apparatus 100 such that the viewing area of the camera 150 includes at least the first wrench head 102 and the second wrench head 104. For example, in one embodiment, the camera 150 may be positioned at location 120. In another embodiment, such as the embodiment illustrated in FIG. 1B, the camera 150 may be positioned at location 122. According to an embodiment, the apparatus 100 may be able to be used at water depths up to 3500 meters, and the camera 150 may allow an operator of a remotely operated underwater vehicle (ROV) or a well to remotely view at least the first wrench head 102 and the second wrench head 104 as the apparatus 100 attempts to remove and/or replace a hose coupled to a subsea electromechanical structure, such as a BOP.

Although the illustration of FIG. 1A shows that the first wrench head 102 is a hex wrench head for coupling to (e.g., receiving) a hex hose fitting, the first wrench head 102 may, in general, be adjustable or interchangeable such that the first wrench head 102 matches the shape of the hose fitting Likewise, the second wrench head 104 may be a hex wrench head as shown in FIG. 1A, but it need not be a hex wrench head, and instead the second wrench head 104 may, in general, be adjustable or interchangeable such that the second wrench head 104 matches the shape of the swivel fitting coupled to a hose. In general, the inner shape of the first wrench head 102 and/or the second wrench head 104 may be whatever shape necessary to couple to the hose fitting and the swivel fitting, respectively, without departing from this disclosure in spirit or scope.

Figure 3:
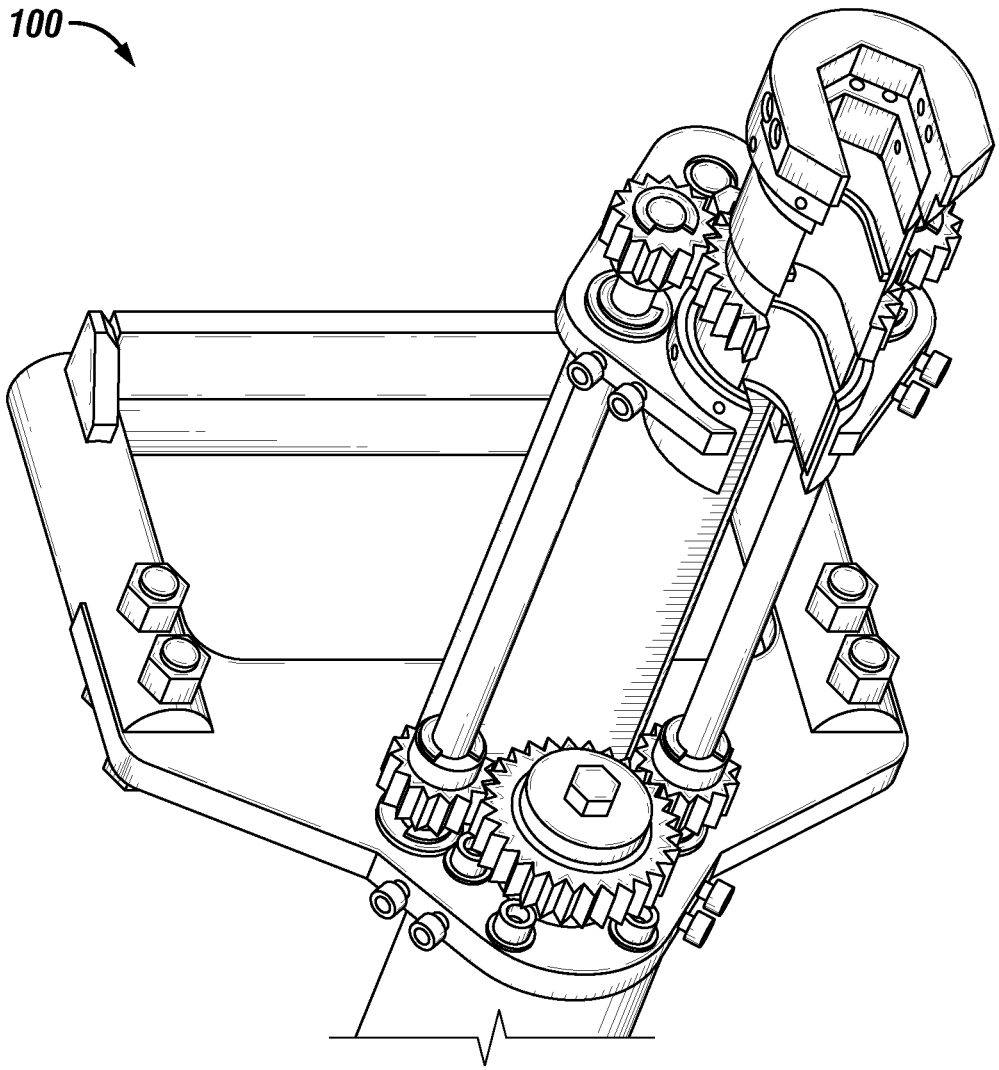
FIG. 3 is a schematic model illustrating a bottom view of an apparatus for replacing a hose coupled to a BOP located subsea according to one embodiment of the disclosure.
Figure 4:
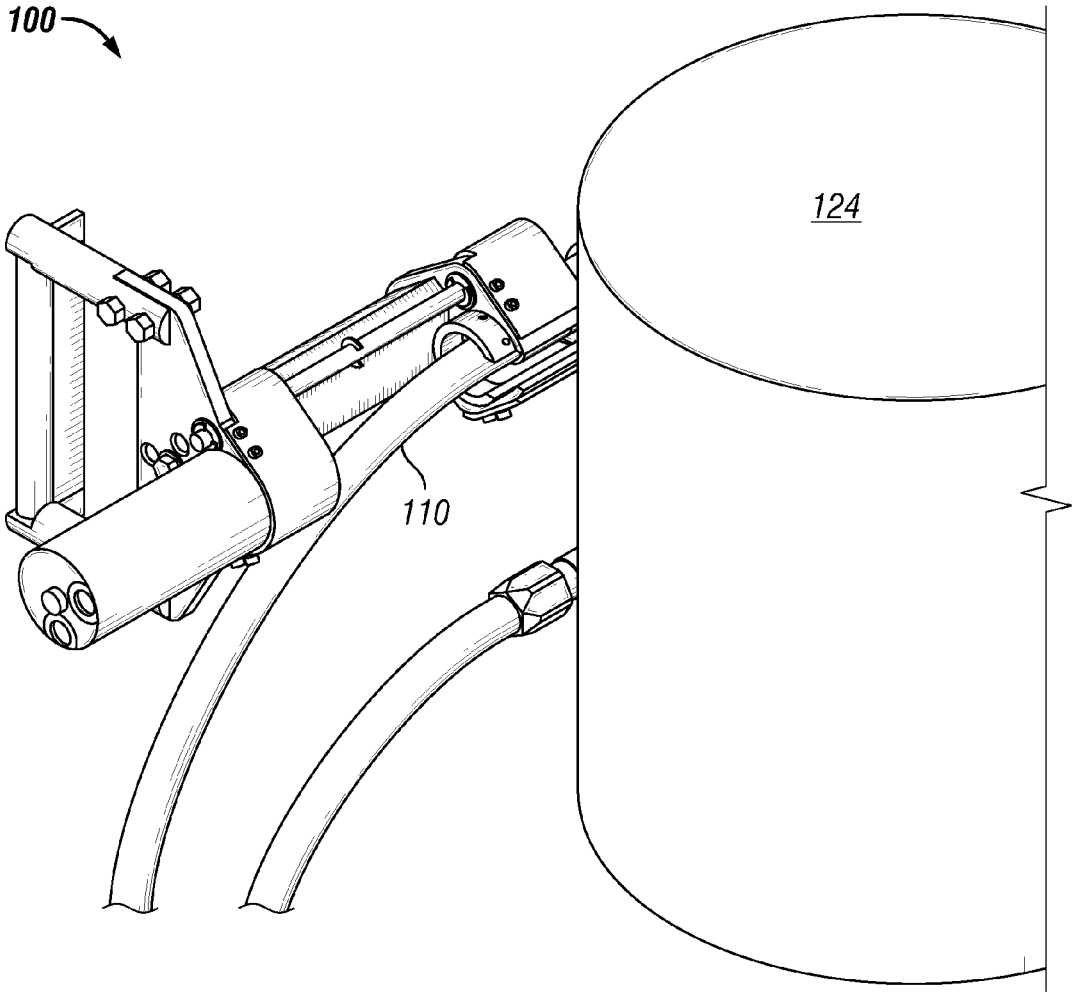
FIG. 4 is a schematic model illustrating an apparatus engaged for replacing a hose coupled to a BOP located subsea according to one embodiment of the disclosure.

FIG. 3 is a schematic model illustrating a bottom view of the apparatus 100 for replacing a hose coupled to a BOP located subsea according to one embodiment of the disclosure, and FIG. 4 is a schematic model illustrating the apparatus 100 engaged for replacing a hose coupled to a BOP located subsea according to one embodiment of the disclosure. For example, FIG. 4 illustrates the apparatus 100 in position to rotate the swivel fitting to decouple the hose 110 from the hose fitting that is coupled to the BOP 124. Because the same apparatus 100 may be used to couple a new hose to the hose fitting, in another embodiment, FIG. 4 may illustrate the apparatus 100 in position to rotate the swivel fitting to couple a new hose to the hose fitting that is coupled to the BOP 124.

In view of exemplary systems shown and described herein, methodologies that may be implemented in accordance with the disclosed subject matter will be better appreciated with reference to various functional block diagrams. While, for purposes of simplicity of explanation, methodologies are shown and described as a series of acts/blocks, it is to be understood and appreciated that the claimed subject matter is not limited by the number or order of blocks, as some blocks may occur in different orders and/or at substantially the same time with other blocks from what is depicted and described herein. Moreover, not all illustrated blocks may be required to implement methodologies described herein. It is to be appreciated that functionality associated with blocks may be implemented by the systems disclosed herein or other electromechanical structures without deviating from this disclosure in spirit or scope.

Figure 5:
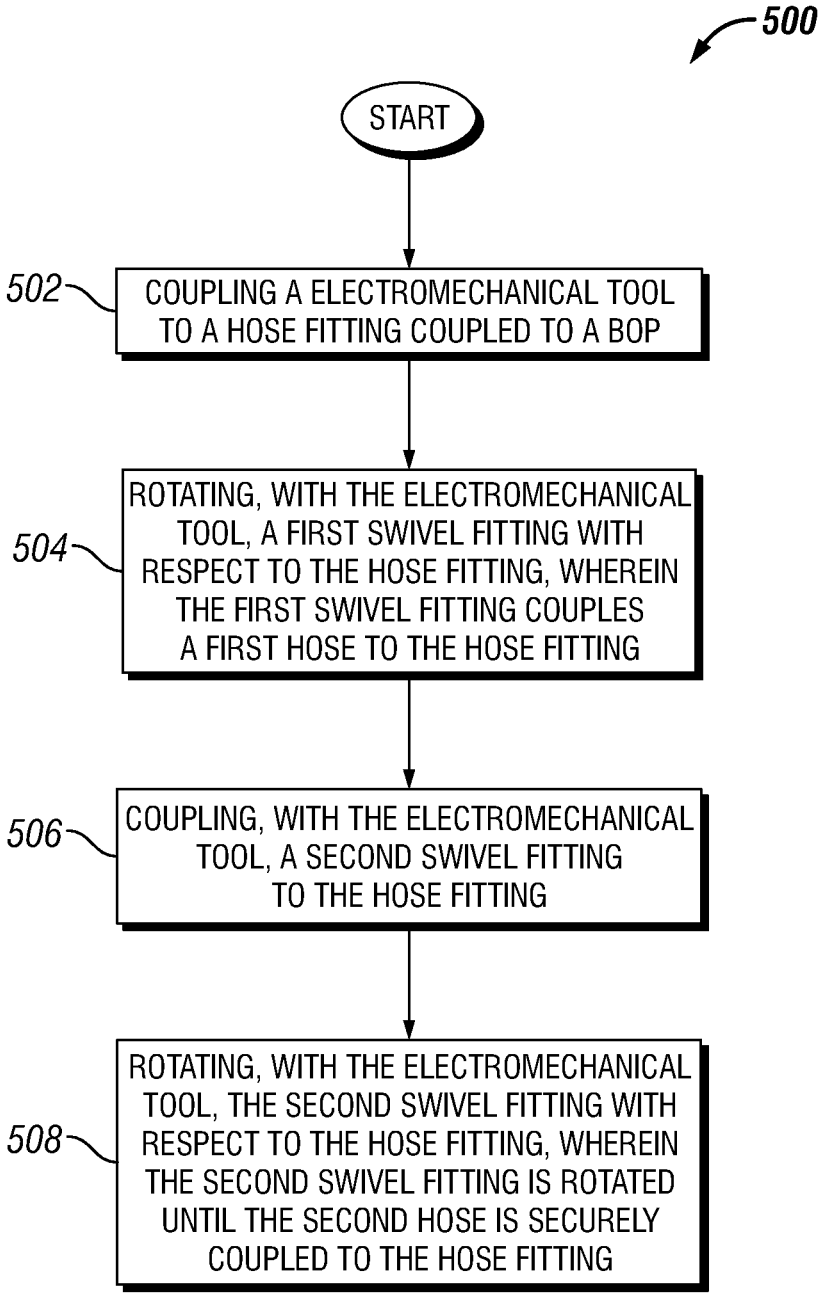
FIG. 5 is a flow chart diagram illustrating a method for replacing a hose coupled to BOP located subsea according to one embodiment of the disclosure.

FIG. 5 illustrates a method 500 for replacing a hose coupled to BOP located subsea according to one embodiment of the disclosure. It is noted that embodiments of method 500 may be implemented with the systems described above with respect to FIGS. 1 and 3-4. For example, embodiments of method 500 may be implemented by apparatus 100. In general, embodiments of method 500 may be implemented by other electromechanical structures without deviating from this disclosure so long as the electromechanical structures, whether directly or indirectly, support the operations as described herein.

Specifically, method 500 of the illustrated embodiments includes, at block 502, coupling an electromechanical tool to a hose fitting coupled to a BOP. At block 504, method 500 also includes rotating, with the electromechanical tool, a first swivel fitting with respect to the hose fitting, wherein the first swivel fitting couples a first hose to the hose fitting. When the first swivel fitting is being rotated to decouple the first hose, the first swivel fitting may be rotated until the first hose is decoupled from the hose fitting. In some embodiments, at least a first portion of the electromechanical tool remains coupled to the hose fitting while at least a second portion of the electromechanical tool rotates the first swivel fitting.

At block 506, method 500 includes coupling, with the electromechanical tool, a second swivel fitting to the hose fitting. According to an embodiment, the second swivel fitting may couple a second hose to the hose fitting. For example, with the first hose removed from the hose fitting, a replacement hose may be coupled to the hose fitting. In some embodiments, the electromechanical tool may retrieve the replacement hose from an offshore vessel at the surface after decoupling the first hose from the hose fitting. In another embodiment, the electromechanical tool may be configured to hold the replacement hose while decoupling the first swivel fitting, and therefore the first hose, from the hose fitting. Therefore, according to some embodiments, the electromechanical tool, such as, for example, apparatus 100, may also include a grasping unit configured to hold the second hose (e.g., replacement hose). In yet another embodiment, a second tool may hold the replacement hose in close proximity to the electromechanical tool while the electromechanical tool decouples the first swivel fitting from the hose fitting.

Method 500, as shown in FIG. 5, also includes, at block 508, rotating, with the electromechanical tool, the second swivel fitting with respect to the hose fitting, wherein the second swivel fitting is rotated until the second hose is securely coupled to the hose fitting. According to one embodiment, the electromechanical tool may include a pressure setting that sets the torque value that can be used to secure the second hose to the hose fitting, and the second hose may be securely coupled to the hose fitting when the torque value is reached. In some embodiments, the electromechanical tool may include a torque limiter to avoid over torque, which may cause damage to a fitting. According to an embodiment, the torque value may vary based on the type, size, material, and other characteristics of the fitting, and the pressure setting of the electromechanical tool may be adjusted to account for different torque values.

According to an embodiment, at least a first portion of the electromechanical tool remains coupled to the hose fitting while at least a second portion of the electromechanical tool rotates the second swivel fitting. In some embodiments, the electromechanical tool may include a motor coupled to a plurality of gears and the at least second portion of the electromechanical tool to cause the at least second portion to rotate the first swivel fitting, such as when decoupling the first hose from the hose fitting, or the second swivel fitting, such as when coupling the second hose to the hose fitting.

According to one embodiment, the electromechanical tool may be remotely operated with an ROV, while in another embodiment, the electromechanical tool may be remotely operated from an offshore vessel, where the electromechanical tool receives instructions/controls from an operator on the offshore vessel. Therefore, in some embodiments, the electromechanical tool may include a camera to remotely view the area that includes at least the hose fitting and either of the first swivel fitting or the second swivel fitting.

The schematic flow chart diagram of FIG. 5 is generally set forth as a logical flow chart diagram. As such, the depicted order and labeled steps are indicative of one embodiment of the disclosed method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

While the embodiments of the disclosure described herein have been described with reference to numerous specific details, one of ordinary skill in the art will recognize that the embodiments of the disclosure can be embodied in other specific forms without departing from the spirit of the embodiments of the disclosure. Thus, one of ordinary skill in the art would understand that the embodiments described herein are not to be limited by the foregoing illustrative details, but rather are to be defined by the appended claims.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present invention, disclosure, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. An apparatus for replacing a first hose coupled to a blowout preventer (BOP) located subsea, the apparatus comprising:

a first wrench head configured to couple to a hose fitting coupled to the BOP;

a second wrench head coupled to the first wrench head and configured to couple to a swivel fitting, wherein the swivel fitting couples a first hose to the hose fitting, and wherein the second wrench head is configured to couple the swivel fitting to the hose fitting; and a powering unit coupled to the second wrench head, wherein the powering unit is configured to cause the second wrench head to rotate with respect to the first wrench head, wherein the rotation of the second wrench head causes the swivel fitting to rotate with respect to the hose fitting.

2. The apparatus of claim 1, wherein the first wrench head remains coupled to the hose fitting and the hose fitting remains coupled to the BOP while the second wrench head and swivel fitting rotate.

3. The apparatus of claim 1, wherein the powering unit is a motor.

4. The apparatus of claim 3, further comprising:

a drive gear coupled to the motor;

at least one drive shaft driven by the drive gear; and at least one spur gear driven by the at least one drive shaft, wherein the at least one spur gear transmits torque to the second wrench head to cause the second wrench head to rotate.

5. The apparatus of claim 1, further comprising a camera positioned on the apparatus such that a viewing area of the camera includes at least the first wrench head and the second wrench head.

6. A method for replacing a first hose coupled to a blowout preventer (BOP) located subsea, comprising:

coupling an electromechanical tool to a hose fitting coupled to the BOP;

rotating, with the electromechanical tool, a first swivel fitting with respect to the hose fitting, wherein the first swivel fitting couples a first hose to the hose fitting, and wherein the first swivel fitting is rotated until the first hose is decoupled from the hose fitting;

coupling, with the electromechanical tool, a second swivel fitting to the hose fitting, wherein the second swivel fitting couples a second hose to the hose fitting; and rotating, with the electromechanical tool, the second swivel fitting with respect to the hose fitting, wherein the second swivel fitting is rotated until the second hose is securely coupled to the hose fitting.

7. The method of claim 6, wherein at least a first portion of the electromechanical tool remains coupled to the hose fitting while at least a second portion of the electromechanical tool rotates the first swivel fitting or the second swivel fitting.

8. The method of claim 7, wherein the electromechanical tool comprises a motor coupled to a plurality of gears and the at least second portion of the electromechanical tool to cause the at least second portion to rotate the first swivel fitting or the second swivel fitting.

9. The method of claim 6, further comprising remotely viewing, with a camera coupled to the electromechanical tool, the area that includes at least the hose fitting and the first swivel fitting or the second swivel fitting.

* * * * *